US008414314B1

(12) United States Patent
Mosholder

(10) Patent No.: US 8,414,314 B1
(45) Date of Patent: Apr. 9, 2013

(54) SINGLE-USE USB PORT PROTECTOR

(75) Inventor: Gary S. Mosholder, Sykesville, MD (US)

(73) Assignee: The United States of America as represented by the Director, National Security Agency, Washington, DC (US)

( * ) Notice: Subject to any disclaimer, the term of this patent is extended or adjusted under 35 U.S.C. 154(b) by 7 days.

(21) Appl. No.: 13/374,180

(22) Filed: Dec. 7, 2011

(51) Int. Cl.
*H01R 13/44* (2006.01)

(52) U.S. Cl.
USPC ..... 439/148; 439/133

(58) Field of Classification Search ..... 439/135, 439/148, 133
See application file for complete search history.

(56) References Cited

U.S. PATENT DOCUMENTS

| | | | | |
|---|---|---|---|---|
| 5,642,805 | A * | 7/1997 | Tefft | 200/43.08 |
| 6,796,152 | B1 * | 9/2004 | Yu | 70/58 |
| 6,802,723 | B2 * | 10/2004 | Decime et al. | 439/135 |
| 6,991,479 | B2 * | 1/2006 | Miao | 439/133 |
| 7,083,438 | B2 | 8/2006 | Massaro et al. | |
| 7,128,586 | B2 * | 10/2006 | Kung | 439/133 |
| 7,160,137 | B1 * | 1/2007 | Yeh | 439/358 |
| 7,223,574 | B2 * | 5/2007 | Lei et al. | 435/135 |
| 7,275,941 | B1 * | 10/2007 | Bushby | 439/133 |
| 7,390,201 | B1 | 6/2008 | Quinby et al. | |
| 7,428,834 | B1 * | 9/2008 | Lee | 70/57 |
| 7,462,045 | B1 * | 12/2008 | Lee | 439/133 |
| 7,479,021 | B2 * | 1/2009 | Huang | 439/133 |
| 7,530,824 | B2 | 5/2009 | Bolain | |
| 7,563,113 | B2 | 7/2009 | Sheng | |
| 7,581,417 | B1 * | 9/2009 | Chen | 70/57 |
| 7,635,272 | B2 * | 12/2009 | Poppe | 439/133 |
| 7,677,065 | B1 * | 3/2010 | Miao | 70/57 |
| 7,722,369 | B2 * | 5/2010 | Bushby | 439/134 |
| 7,794,245 | B2 * | 9/2010 | Thompson | 439/135 |
| 7,913,527 | B2 * | 3/2011 | Chen | 70/57 |
| 8,029,299 | B1 * | 10/2011 | Huang | 439/135 |
| 8,142,212 | B2 * | 3/2012 | McSweeney et al. | 439/135 |
| 2003/0224637 | A1 * | 12/2003 | Ling | 439/133 |
| 2003/0228777 | A1 * | 12/2003 | Lai | 439/133 |
| 2005/0039502 | A1 * | 2/2005 | Avganim | 70/58 |
| 2005/0202698 | A1 * | 9/2005 | Miao | 439/133 |
| 2006/0107073 | A1 * | 5/2006 | Lane et al. | 713/194 |
| 2006/0134952 | A1 * | 6/2006 | Meister et al. | 439/148 |
| 2006/0234533 | A1 * | 10/2006 | Lei et al. | 439/135 |
| 2007/0037454 | A1 * | 2/2007 | Bushby | 439/680 |
| 2007/0162655 | A1 * | 7/2007 | Huang | 710/36 |
| 2008/0041125 | A1 * | 2/2008 | Poppe | 70/57 |
| 2009/0042433 | A1 * | 2/2009 | Bushby | 439/352 |
| 2009/0117763 | A1 * | 5/2009 | Chen | 439/148 |
| 2010/0033913 | A1 * | 2/2010 | Cao | 361/679.4 |
| 2012/0108088 | A1 * | 5/2012 | Peng et al. | 439/135 |
| 2012/0289069 | A1 * | 11/2012 | Chueh et al. | 439/135 |

* cited by examiner

*Primary Examiner* — Ross Gushi
(74) *Attorney, Agent, or Firm* — Robert D. Morelli

(57) ABSTRACT

A single-use Universal Serial Bus port protector having a top piece and a tongued planar surface, where the top piece includes a rectangular surface, a rectangular planar surface, a slotted planar surface, and at least one lever breakably attached to the slotted planar surface, and where the tongued planar surface includes two rails and two projections, where the top piece and the tongued planar surface are slideably insertable into a Universal Serial Bus port to ensure that no electrical connection is made to the Universal Serial Bus port when the top piece and the tongued planar surface are so inserted, where the at least one lever engages with at least one of the rails of the tongued planar surface upon insertion, and where the at least one lever breaks off when the Universal Serial Bus port protector is removed from the Universal Serial Bus port.

10 Claims, 12 Drawing Sheets

SINGLE-USE USB PORT PROTECTOR

FIELD OF THE INVENTION

The present invention relates, in general, to electrical connectors and, more particularly, to a dummy connector.

BACKGROUND OF THE INVENTION

Various connector types are used are used to connect a personal computer to another devices. These connectors include an Ethernet connector, an IEEE 1394 connector, a parallel connector, a serial connector, IBM Personal System 2 (PS/2) connector, a Video Graphics Array (VGA) connector, a Digital Visual Interface (DVI) connector, a Small Computer System Interface (SCSI) connector, a Tip Ring Sleeve (TRS) connector, and a Universal Serial Bus (USB) connector. The devices that these connectors connect to a personal computer include a keyboard, a printer, a disk drive, a portable media player, and a digital camera.

The socket on a personal computer to which a connector may be connected is commonly referred to as a port.

A port on a computer is a known vulnerability due to the extrication of data from the computer or the infiltration of malicious software onto the computer than may occur via the port. Therefore, there is a need for a device that renders a port unusable when a user of a computer desires. The present invention is such a device for a USB port.

U.S. Pat. No. 7,083,438, entitled "LOCKING COVERS FOR CABLE CONNECTORS AND DATA PORTS FOR USE IN DETERRING SNOOPING OF DATA IN DIGITAL DATA PROCESSING SYSTEMS," discloses an L-shaped latch for blocking an open end of a cable. U.S. Pat. No. 7,083,438 is incorporated by reference into the specification of the present invention.

U.S. Pat. No. 7,390,201, entitled "DATA POINT SECURITY LOCK," discloses a plug that is compliant with a connector standard having an aperture to engage a latch in the connector that partially extends through the aperture and locks to the connector. U.S. Pat. No. 7,390,201 is incorporated by reference into the specification of the present invention.

U.S. Pat. No. 7,530,824, entitled "LOCKING SEAL FOR DATA PORTS AND ASSOCIATED METHODS," discloses a one-time use device having a base with side longitudinal slots, a protrusion extending upwardly into the slot, a ramp that slopes upward, and a stop higher than the ramp, where the protrusion prevents the device from being removed intact once inserted into a port. U.S. Pat. No. 7,530,824 is incorporated by reference into the specification of the present invention.

U.S. Pat. No. 7,563,113, entitled "WATERPROOF PLUG FOR DATA PORT OF PORTABLE ELECTRONIC DEVICE," discloses a cover plate, a sealing flange extended from a data port sealing surface of the cover plate, and a water-guiding groove along the sealing flange. U.S. Pat. No. 7,563,113 is incorporated by reference into the specification of the present invention.

SUMMARY OF THE INVENTION

It is an object of the present invention to prevent connection with a Universal Serial Bus (USB) connector port.

It is another object of the present invention to prevent connection with a Universal Serial Bus connector port via a single-use top piece and a tongued planar surface.

The present invention is a single-use USB port protector.

A single-use Universal Serial Bus port protector having a top piece and a tongued planar surface, where the top piece includes a rectangular surface, a rectangular planar surface, a slotted planar surface, and at least one lever breakably attached to the slotted planar surface, and where the tongued planar surface includes two rails and two projections, where the top piece and the tongued planar surface are slideably insertable into a Universal Serial Bus port to ensure that no electrical connection is made to the Universal Serial Bus port when the top piece and the tongued planar surface are so inserted, where the at least one lever engages with at least one of the rails of the tongued planar surface upon insertion, and where the at least one lever breaks off when the Universal Serial Bus port protector is removed from the Universal Serial Bus port.

DETAILED DESCRIPTION OF THE PREFERRED EMBODIMENT

The present invention is a single-use Universal Serial Bus (USB) port protector.

Figure 1:
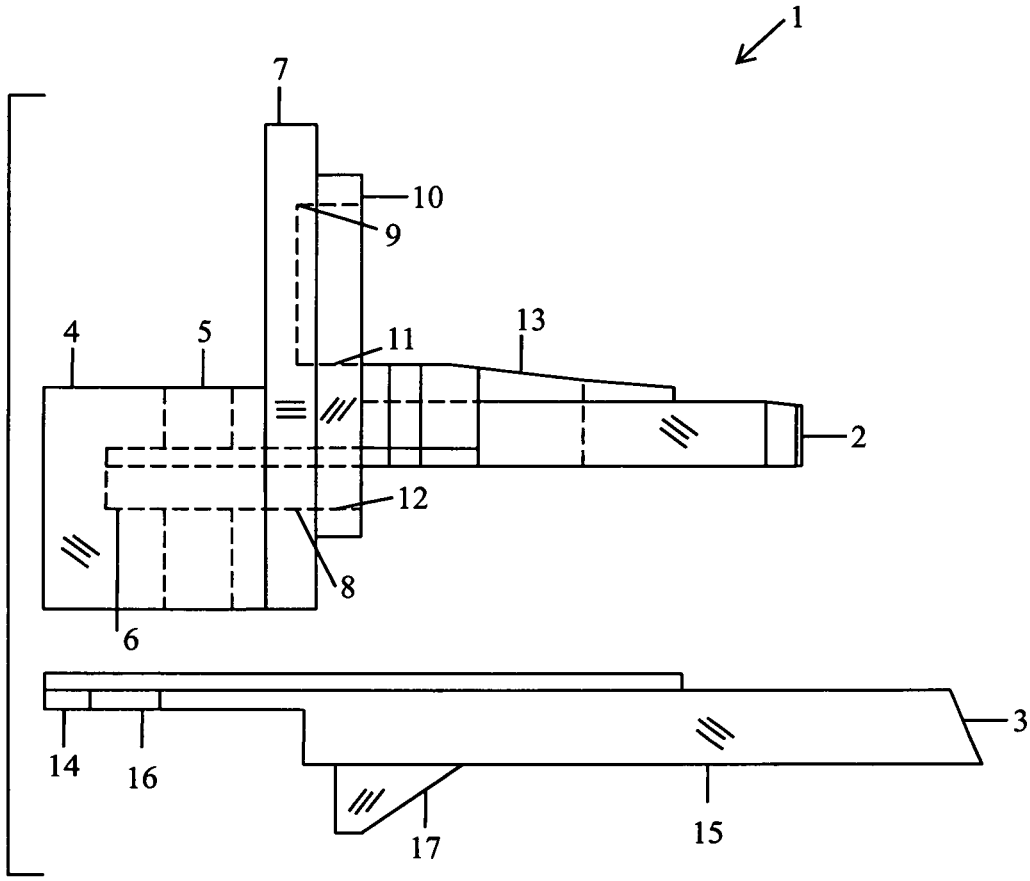
FIG. 1 is a side view of the present invention.

FIG. 1 is a side view of the single-use USB port protector 1 of the present invention. The USB port protector 1 includes a top piece 2 and a tongued planar surface 3.

The top piece 2 includes a rectangular surface 4. The rectangular surface 4 has a user-definable length along an x-axis (going into FIG. 1), a user-definable width along a z-axis (going left to right across FIG. 1), a user-definable height along a y-axis (going from the bottom to the top of FIG. 1), a top, a bottom, and a back. In an alternate embodiment, the rectangular surface 4 has a hole 5 of a user-definable diameter extending from the top of the rectangular surface 4 through the bottom of the rectangular surface 4. The rectangular surface 4 also has a blind mortise 6 (i.e., a rectangular cut in an item that does not extend all the way through the item) of a user-definable length in the back of and along the length of the rectangular surface 4. The top piece 2 is comprised of a material selected from the group of materials consisting of plastic, glass, polymer, wood, epoxy, polyurethane, and acrylic resin.

The top piece 2 also includes a rectangular planar surface 7. The rectangular planar surface 7 has a top, a front, a back, and a length equal to the length of the rectangular surface 4. The front of the rectangular planar surface 7 abuts the back of the rectangular surface 4. The rectangular planar surface 7 has a mortise 8 (i.e., a rectangular cut in an item that extends all the way through the item) in the back of the rectangular planar surface 7 that is in alignment with and of the same length as the blind mortise 6 in the rectangular surface 4. The rectangular planar surface 7 also has a blind mortise 9 in the back of the rectangular planar surface 7 proximal to the top of the rectangular planar surface 7 that is not in alignment with but has the same length as the blind mortise 6 in the rectangular surface 4.

The top piece 2 also includes a slotted planar surface 10 of a user-definable height, having a bottom and a top, having a first mortise 11, having a second mortise 12, where the bottom of the slotted planar surface 10 abuts the back of the rectangular planar surface 7 so that the blind mortise 9 of the rectangular planar surface 7 is enclosed within the first mortise 11, and where the mortise 8 of the rectangular planar surface 7 is enclosed within the second mortise 12.

The top piece 2 also includes at least one lever 11 breakably attached to the top of the slotted planar surface 10. In the preferred embodiment, two levers 11 are breakably attached to the top of the slotted planar surface 10. The at least one lever 11 engages the tongued planar surface 3 as described below.

The tongued planar surface 3 of the USB port protector 1 has a top and a bottom, has a tongued portion 14, has an untongued portion 15, where the tongued portion 14 extends from the top of the tongued planar surface 3 and has the same width as the mortise 8 in the rectangular planar surface 7, where the un-tongued portion 15 has a user-definably greater width and height than the tongued portion 14, having at least one rail 91 on the top of the tongued planar surface 3 so the at least one rail 91 traverses the tongued portion 14 and encroaches a user-definable distance onto the untongued portion 15, having two projections 17 extending from the bottom of the untongued portion 15 of the tongued planar surface 3, where the two projections 17 are proximal to the tongued portion 14 of the tongued planar surface 3, where the top piece 2 and the tongued planar surface 3 are slideably insertable into but not extractable from a Universal Serial Bus port without breaking the at least one lever 13 of the top piece 2 to ensure that no electrical connection is made to the Universal Serial Bus port when the top piece 2 and the tongued planar surface 3 are so inserted. The tongued planar surface 3 is comprised of a material selected from the group of materials consisting of plastic, glass, polymer, wood, epoxy, polyurethane, and acrylic resin. In an alternate embodiment where the rectangular surface 4 of the top piece 2 includes a hole 5, the tongued portion 14 includes a hole 16 there through that aligns with the hole 5 in the rectangular surface 4 of the top piece 2 when the tongued portion 14 of the tongued planar surface 3 is inserted into the rectangular surface 4 of the top piece 2.

The Universal Serial Bus port protector 1 further including in the alternate embodiment a wire (not shown) having a first end and a second end, where the wire is inserted through the hole 5 of the top piece 2 and the hole 16 in the tongued planar surface 3, and where the first end and the second end are securely attached. The wire is comprised of a material selected from the group of materials consisting of copper, steel, nickel, aluminum, plastic, acrylic resin, and polyethylene. The first end and the second end of the wire is secured by a securing method consisting of welding, soldering, cinching, and sintering.

Figure 2:
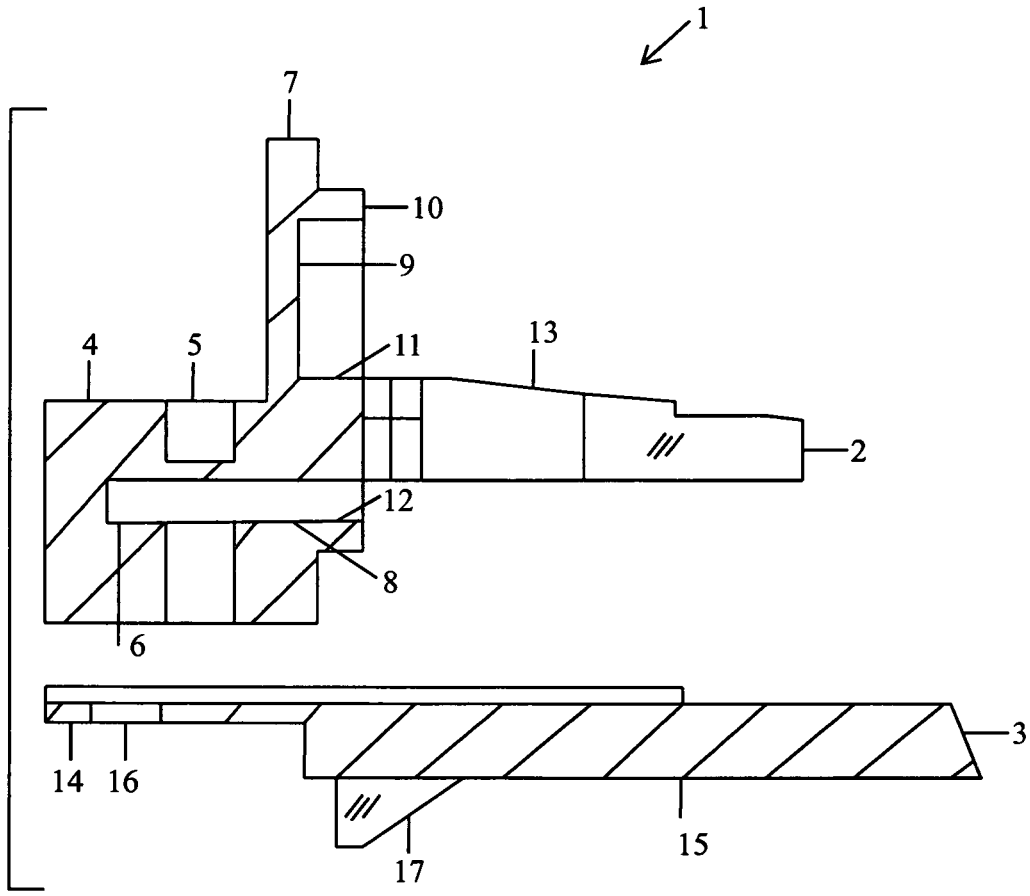
FIG. 2 is a side cross-sectional view of the present invention.

FIG. 2 is a side cross-sectional view of the USB port protector 1 of FIG. 1 showing the top piece 2, the rectangular surface 4, the hole 5 in the of the alternate embodiment of the rectangular surface 4, the blind mortise 6 in the rectangular surface 4, the rectangular planar surface 7, the mortise 8 in the rectangular planar surface 7, the blind mortise 9 in the rectangular planar surface 7, the slotted planar surface 10, the first mortise 11 in the slotted planar surface 10, the second mortise 12 in the slotted planar surface 10, the at least one lever 13, the tongued planar surface 3, the tongued portion 14 of the tongued planar surface 3, the untongued portion 15 of the tongued planar surface 3, the hole 16 in alternate embodiment of the tongued planar surface 3, and the two projections 17 in the tongued planar surface 3.

Figure 3A:
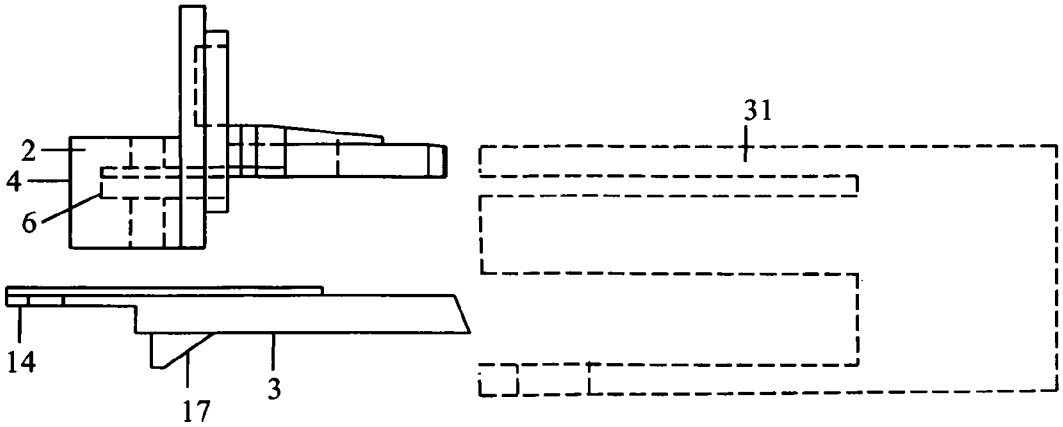
FIGS. 3A-3C are illustrations of the operation of the present invention.
Figure 3B:
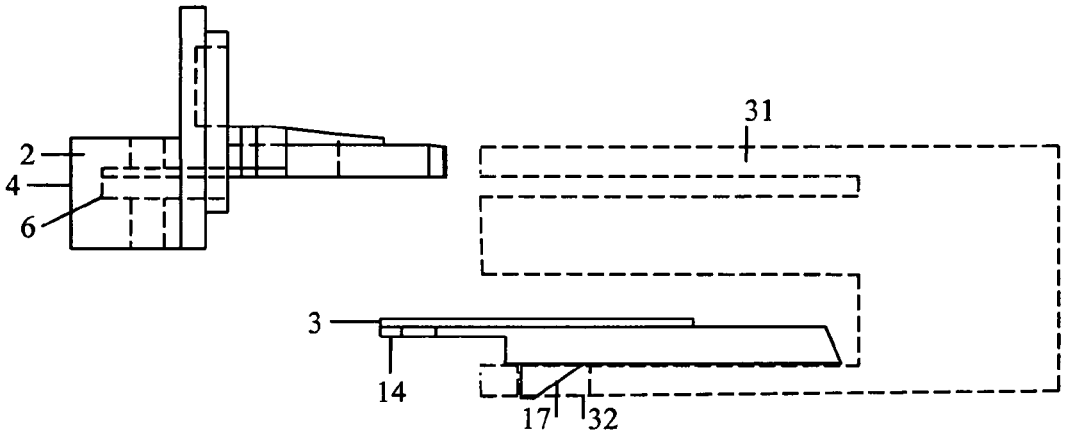
Figure 3C:
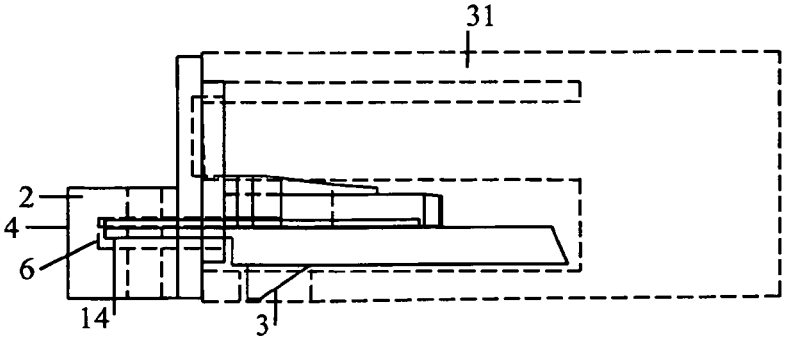

FIGS. 3A-3C are illustrations of the operation of the USB port protector 1. In FIG. 3A, the top piece 2 and the tongued planar surface 3 are separate from a USB port 31. In FIG. 3B, the tongued planar surface 3 is inserted into the USB port 31 so that the two projections 17 of the tongued planar surface 3 are engaged with holes 32 in the USB port 31. In FIG. 3C, the top piece 2 is inserted into the USB port 31 so that the at least one lever 13 of the top piece 2 is engaged with the tongued planar surface 3 as described below and the tongued portion 14 of the tongued planar surface 3 is engaged with the blind mortise 6 of the rectangular surface 4 of the top piece 2.

Figure 4:
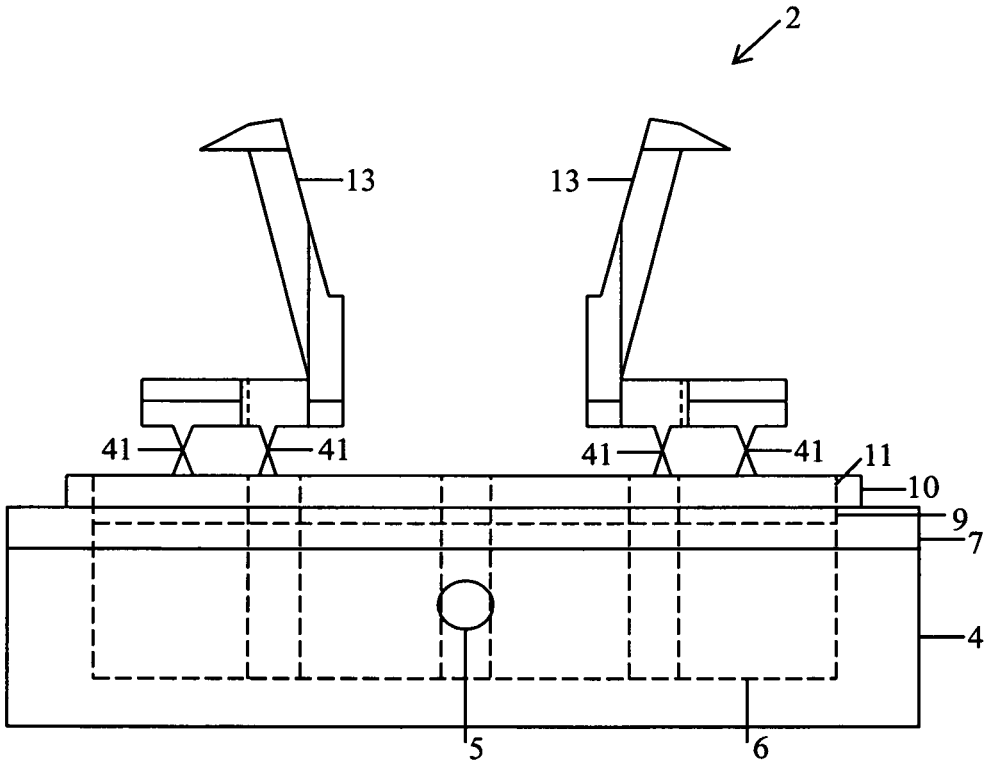
FIG. 4 is a top view of the top piece of the present invention.

FIG. 4 is a top view of the top piece 2 of the USB port protector 1 showing the rectangular surface 4, the hole 5 in the rectangular surface 4 in the alternate embodiment, the blind mortise 6 in the rectangular surface 4, the rectangular planar surface 7, the blind mortise 9 in the rectangular planar surface 7, the slotted planar surface 10, the first mortise 11 in the slotted planar surface 10, the at least one lever 13, where each at least one lever 13 is breakably attached to the slotted planar surface 10 by at least one breakable connectors 41.

Figure 5:
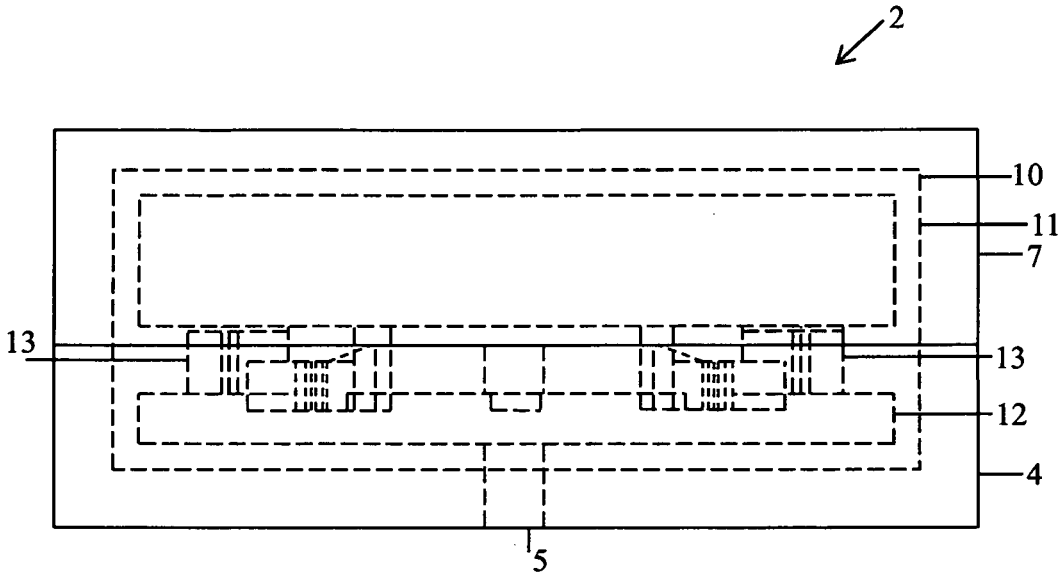
FIG. 5 is a front view of the top piece of the present invention.

FIG. 5 is a front view of the top piece 2 of the USB port protector 1 showing the rectangular surface 4, the hole 5 in the rectangular surface 4 in the alternate embodiment, the rectangular planar surface 7, the slotted planar surface 10, the first mortise 11 in the slotted planar surface 10, the second mortise 12 in the slotted planar surface 10, and the at least one lever 13.

Figure 6:
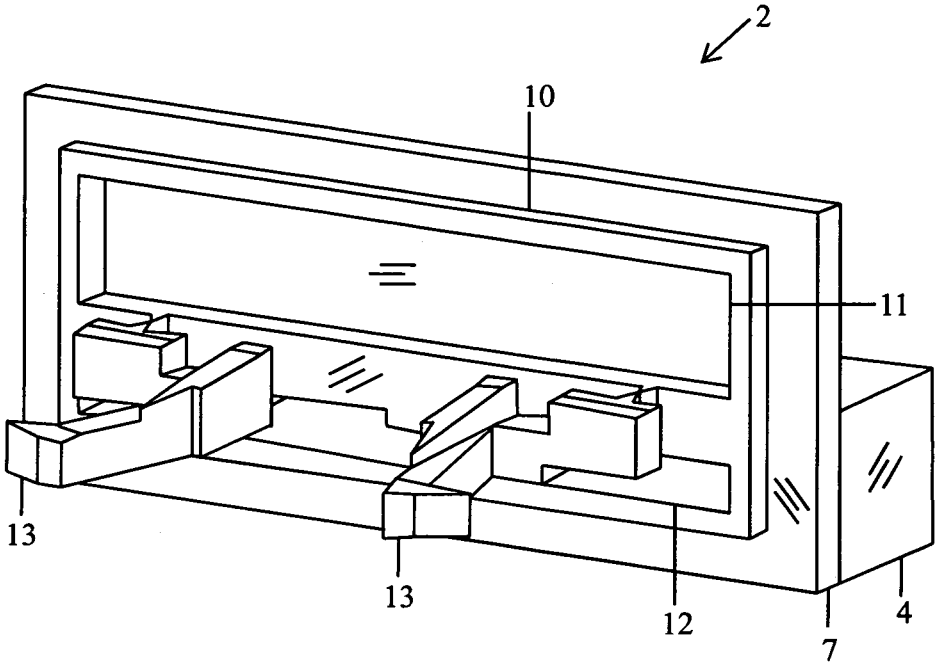
FIG. 6 is a back-side perspective view of the top piece of the present invention.

FIG. 6 is a back-side perspective view of the top piece 2 of the USB port protector 1 showing the rectangular surface 4, the rectangular planar surface 7, the slotted planar surface 10, the first mortise 11 in the slotted planar surface 10, the second mortise 12 in the slotted planar surface 10, and the at least one lever 13.

Figure 7:
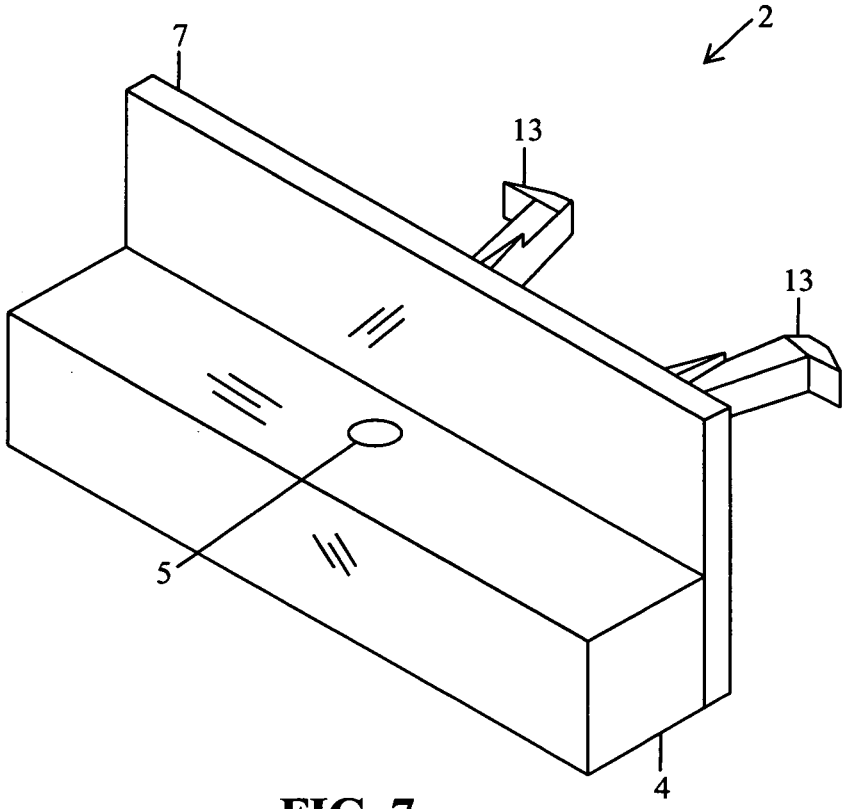
FIG. 7 is a top-side perspective view of the top piece of the present invention.

FIG. 7 is a top-side perspective view of the top piece 2 of the USB port protector 1 showing the rectangular surface 4, the hole 5 in the rectangular surface 4 in the alternate embodiment, the rectangular planar surface 7, and the at least one lever 13.

Figure 8:
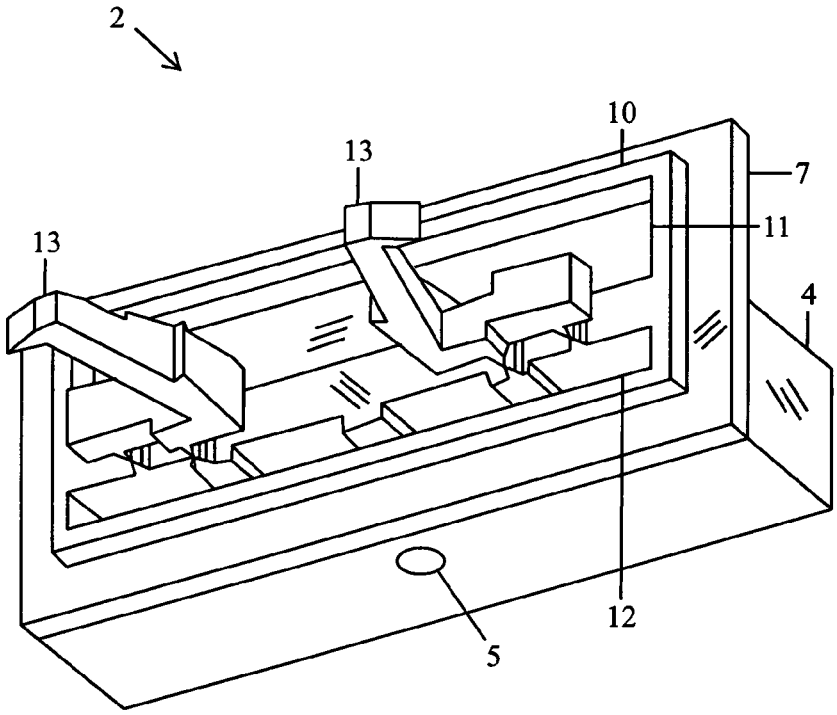
FIG. 8 is a bottom-side view of the top piece of the present invention.

FIG. 8 is a bottom-side perspective view of the top piece 2 of the USB port protector 1 showing the rectangular surface 4, the hole 5 in the rectangular surface 4 in the alternate embodiment, the rectangular planar surface 7, the slotted planar surface 10, the first mortise 11 in the slotted planar surface 10, the second mortise 12 in the slotted planar surface 10, and the at least one lever 13.

Figure 9:
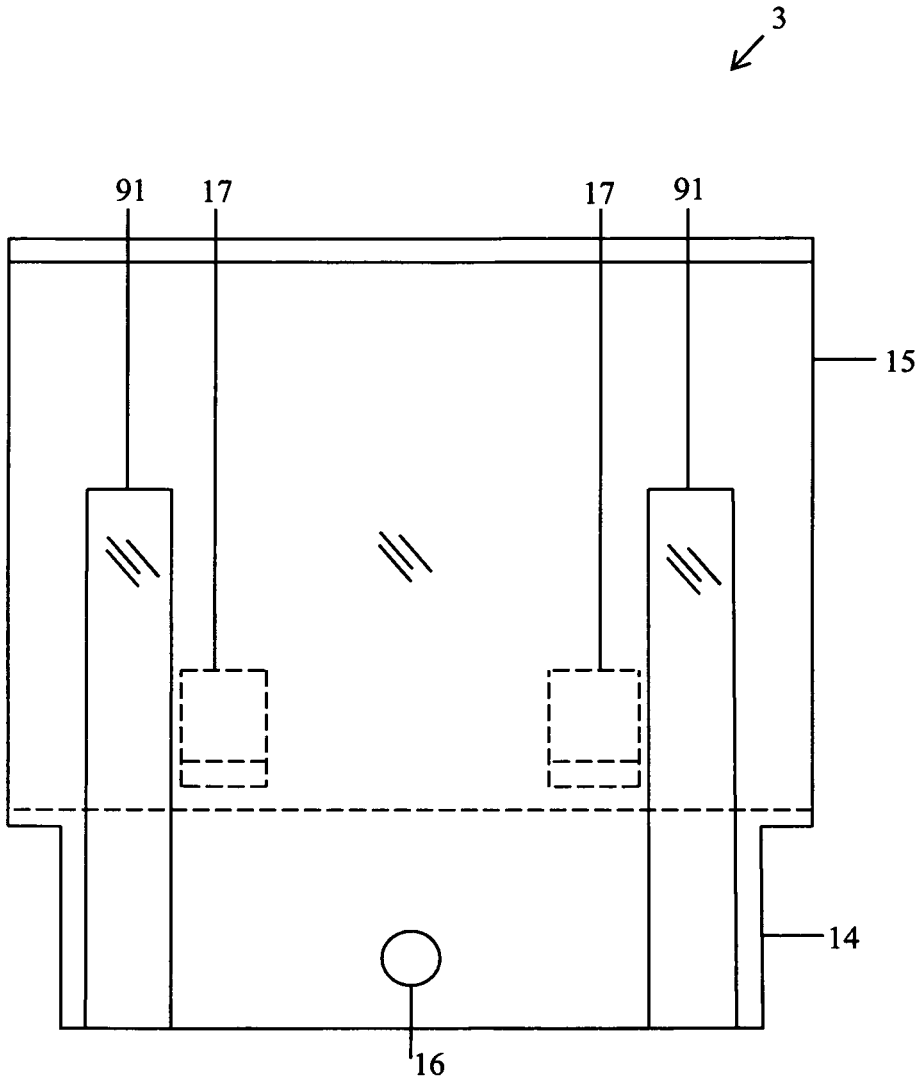
FIG. 9 is a top view of the tongued planar surface of the present invention.

FIG. 9 is a top view of the tongued planar surface 3 of the USB port protector 1 showing the tongued portion 14, the untongued portion 15, the hole 16 in the tongued portion 14 of the tongued planar surface 3 in the alternate embodiment, the two projections 17 on the bottom of the untongued portion 15 of the tongued planar surface 3, and the at least one rail 91 that traverses the tongued portion 14 and encroaches a user-definable portion of the untongued portion 15. The at least one lever 13 of the top piece 2 engages the at least one rail 91 upon insertion of the tongued planar surface 3 and the top piece into a USB port so that removing the top piece 2 from the USB port causes the at least one lever 13 to break away from the top piece 2 and, therefore, provides evidence to the user of the present invention that someone has attempted to access the USB port.

Figure 10:
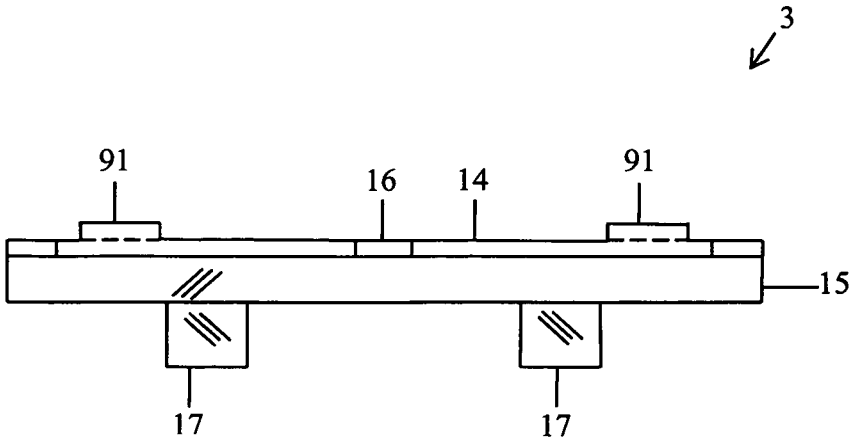
FIG. 10 is a front view of the tongued planar surface of the present invention.

FIG. 10 is a front view of the tongued planar surface 3 of the USB port protector 1 showing the tongued portion 14, the untongued portion 15, the hole 16 in the tongued portion 14 of the tongued planar surface 3 in the alternate embodiment, the two projections 17 on the bottom of the untongued portion 15 of the tongued planar surface 3, and the at least one rail.

Figure 11:
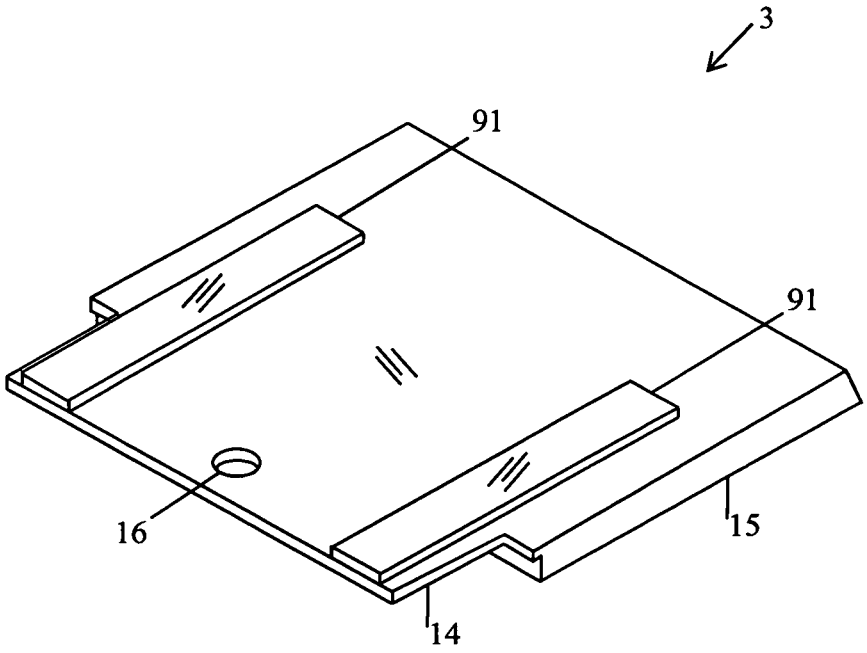
FIG. 11 is a top-side perspective view of the tongued planar surface of the present invention.

FIG. 11 is a top-side perspective view of the tongued planar surface 3 of the USB port protector 1 showing the tongued portion 14, the untongued portion 15, the hole 16 in the tongued portion 15 of the tongued planar surface 3, and the at least one rail 91.

Figure 12:
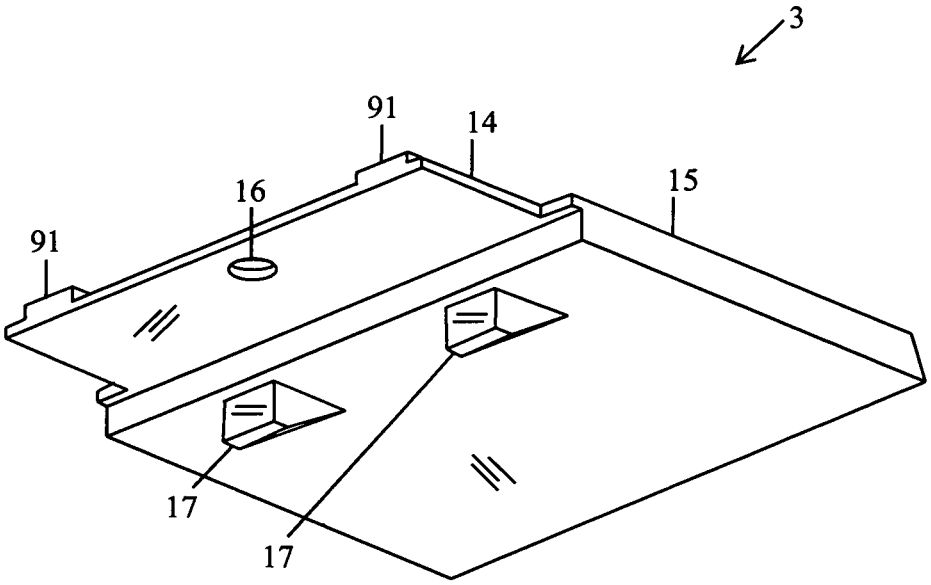
FIG. 12 is a bottom-side perspective view of the tongued planar surface of the present invention.

FIG. 12 is a bottom-side perspective view of the tongued planar surface 3 of the USB port protector 1 showing the tongued portion 14, the untongued portion 15, the hole 16 in the tongued portion 14 of the tongued planar surface 3 in the alternate embodiment, the two projections 17 on the bottom of the untongued portion 15 of the tongued planar surface 3, and the at least one rail 91.

What is claimed is:

1. A single-use Universal Serial Bus port protector, comprising:

a) a top piece, comprising:

i) a rectangular surface, having a user-definable length along an x-axis, having a user-definable width along a z-axis, having a user-definable height along a y-axis, having a top, having a bottom, having a back, and having a blind mortise of a user-definable length in the back of and along the length of the rectangular surface;

ii) a rectangular planar surface, having a top, having a front, having a back, having a length equal to the length of the rectangular surface, where the front of the rectangular planar surface abuts the back of the rectangular surface, having a mortise in the back of the rectangular planar surface in alignment with and of the same length as the blind mortise in the rectangular surface, and having a blind mortise in the back of the rectangular planar surface that is proximal to the top of the rectangular planar surface that is not in alignment with but has the same length as the blind mortise in the rectangular surface;

iii) a slotted planar surface of a user-definable height, having a bottom and a top, having a first mortise, having a second mortise, where the bottom of the slotted planar surface abuts the back of the rectangular planar surface so that the blind mortise in the rectangular planar surface is enclosed within the first mortise, and where the mortise in the rectangular planar surface is enclosed within the second mortise; and iv) at least one lever breakably attached to the top of the slotted planar surface; and b) a tongued planar surface, having a top and a bottom, having a tongued portion and an untongued portion, where the tongued portion extends from the top of the tongued planar surface and has the same width as the mortise in the rectangular planar surface, where the untongued portion has a user-definably greater width and height than the tongued portion, having at least one rail on the top of the tongued planar surface that is engagable by the at least one lever of the top piece and that traverses the tongued portion of the tongued planar surface and encroaches a user-definable distance onto the untongued portion of the tongued planar surface, having two projections extending from the bottom of the untongued portion of the tongued planar surface, where the two projections are proximal to the tongued portion of the tongued planar surface, where the top piece and the tongued planar surface are slideably insertable into but not extractable from a Universal Serial Bus port without breaking the at least one lever of the top piece to ensure that no electrical connection is made to the Universal Serial Bus port when the top piece and the tongued planar surface are so inserted.

2. The Universal Serial Bus port protector of claim 1, wherein the rectangular surface further includes:

a) a first hole of a user-definable diameter extending from the top of the rectangular surface in the top piece through the bottom of the rectangular surface, and b) a second hole that extends through the tongued portion of the tongued planar surface that aligns with the first hole in the rectangular surface of the top piece when the tongued portion of the tongued planar surface is inserted into the rectangular surface of the top piece.

3. The Universal Serial Bus port protector of claim 2, further including a wire having a first end and a second end, where the wire is inserted through the holes in the top piece and the tongued planar surface, and where the first end and the second end are securely attached.

4. The Universal Serial Bus port protector of claim 3, wherein the wire is comprised of a material selected from the group of materials consisting of copper, steel, nickel, aluminum, plastic, acrylic resin, and polyethylene.

5. The Universal Serial Bus port protector of claim 3, wherein the first end and the second end of the wire is secured by a securing method consisting of welding, soldering, cinching, and sintering.

6. The Universal Serial Bus port protector of claim 1, wherein said top piece and said tongued planar surface are each comprised of a material selected from the group of materials consisting of plastic, glass, polymer, wood, epoxy, polyurethane, and acrylic resin.

7. The Universal Serial Bus port protector of claim 6, wherein the rectangular surface further includes:

a) a first hole of a user-definable diameter extending from the top of the rectangular surface in the top piece through the bottom of the rectangular surface, and b) a second hole that extends through the tongued portion of the tongued planar surface that aligns with the first hole in the rectangular surface of the top piece when the tongued portion of the tongued planar surface is inserted into the rectangular surface of the top piece.

8. The Universal Serial Bus port protector of claim 7, further including a wire having a first end and a second end, where the wire is inserted through the holes in the top piece and the tongued planar surface, and where the first end and the second end are securely attached.

9. The Universal Serial Bus port protector of claim 8, wherein the wire is comprised of a material selected from the group of materials consisting of copper, steel, nickel, aluminum, plastic, acrylic resin, and polyethylene.

10. The Universal Serial Bus port protector of claim 9, wherein the first end and the second end of the wire is secured by a securing method consisting of welding, soldering, cinching, and sintering.

* * * * *